US006561263B1

(12) United States Patent
Potier et al.

(10) Patent No.: US 6,561,263 B1
(45) Date of Patent: May 13, 2003

(54) HEAT EXCHANGE DEVICE WITH TWO ARRAYS OF TUBES IN PARTICULAR FOR A MOTOR VEHICLE, AND A METHOD OF MANUFACTURING IT

(75) Inventors: Michel Potier, Rambouillet (FR); Philippe Le Gauyer, Paris (FR)

(73) Assignee: Valeo Thermique Moteur, La Verriere (FR)

( * ) Notice: Subject to any disclaimer, the term of this patent is extended or adjusted under 35 U.S.C. 154(b) by 260 days.

(21) Appl. No.: 09/186,687

(22) Filed: Nov. 5, 1998

(30) Foreign Application Priority Data

Nov. 6, 1997 (FR) ..... 97 13973

(51) Int. Cl.[7] ..... F28F 09/02

(52) U.S. Cl. ..... 165/140; 165/149; 165/150; 165/173

(58) Field of Search ..... 165/140, 150, 165/149, 173; 156/73.5

(56) References Cited

U.S. PATENT DOCUMENTS 3,860,468 A * 1/1975 Scherer ..... 156/73.5
431,577 A 7/1985 Humpolik et al.
5,509,199 A 4/1996 Beamer et al.
5,538,079 A * 7/1996 Pawlick ..... 165/153

FOREIGN PATENT DOCUMENTS

| | | |
|---|---|---|
| EP | 0 429 401 | 5/1991 |
| EP | 0 493 199 | 7/1992 |
| FR | 1 509 031 | 1/1983 |
| WO | 91/19949 | 12/1991 |

* cited by examiner

*Primary Examiner*—Allen Flanigan
(74) *Attorney, Agent, or Firm*—Morgan & Finnegan, LLP

(57) ABSTRACT

A heat exchange device comprises two arrays of tubes through which flow two respective fluids. The device comprises a common support plate for the two arrays, which has a first portion provided with holes to act as a header plate for a first array and a second portion provided with openings for receiving in a forced fit manner the tubes of a second array with curved connectors. In one embodiment of the invention one array contains an engine cooling fluid and the other array contains a refrigerant fluid of an air-conditioning circuit.

14 Claims, 3 Drawing Sheets

HEAT EXCHANGE DEVICE WITH TWO ARRAYS OF TUBES IN PARTICULAR FOR A MOTOR VEHICLE, AND A METHOD OF MANUFACTURING IT

BACKGROUND OF THE INVENTION

1. Field of the Invention

The invention concerns a heat exchange device, in particular for motor vehicles, and a method of manufacturing it.

It is more particularly concerned with a heat exchange device comprising two separate arrays of heat exchange tubes through which respective different fluids flow.

2. Description of the Prior Art

Publication DE 195 36 116 describes a device of the above kind comprising a row of flat tubes the ends of which are assembled to two tubular header boxes extending parallel to each other. Each of the header boxes is divided internally by at least one partition to define a fluid circuit comprising one subset of the tubes of the array and another fluid circuit comprising another subset of the tubes of the array.

The manufacture of the above prior art device necessitates complex assembly operations, in particular involving brazing. Also, it can be effected only with a single row of tubes, which limits its thermal performance.

One aim of the invention is to overcome the aforementioned disadvantages.

The invention aims in particular to provide a heat exchange device with two arrays of tubes which can be obtained by mechanical assembly operations without any brazing.

SUMMARY OF THE INVENTION

The invention proposes a heat exchange device comprising two separate arrays of heat exchange tubes adapted for the flow of different fluids respectively therethrough, and a support plate common to the two arrays and having a first portion with holes to serve as a header for a first array and a second portion with openings for receiving in a forced fit manner the tubes of a second array with curved connectors.

Accordingly the device of the invention combines two heat exchange arrays assembled purely mechanically by means of a support plate which serves simultaneously as the header of a first array and as means for receiving a second array in a forced fit manner.

The above device can be obtained entirely by mechanical assembly, without any brazing, in a single operation.

This results in a compact device that can include one or more rows of tubes.

The tubes of the first array and the tubes of the second array are advantageously parallel to each other.

In one embodiment of the invention the tubes of the first array and the tubes of the second array pass through respective separate first and second sets of fins.

As an alternative to this, the tubes of the first array and the tubes of the second array pass through a common set of fins to constitute a one-piece assembly.

The tubes of the first array are preferably mechanically assembled to the first part of the support plate by means of compressible seals.

In accordance with another feature of the invention the tubes of the first array open into a fluid box having a peripheral edge assembled to the first part of the support plate.

The support plate is advantageously made of a plastics material.

The fluid box can also be made of a plastics material and can then be friction welded to the support plate.

The curved connectors preferably have ends inserted into ends of the tubes of the first array.

In a preferred application of the invention the first array is part of an engine cooling radiator, in particular for a motor vehicle, and the second array is part of a condenser of an air conditioner.

In another aspect the invention comprises a method of manufacturing a heat exchanger comprising the following steps:

a) providing the support plate with curved connectors so that said connectors each have two ends engaged in the crimping openings of the support plate;

b) disposing the tubes of the first array so that their ends face the holes in the support plate;

c) disposing the tubes of the second array so that their ends face the ends of the curved connectors;

d) moving the support plate and the first and second arrays towards each other in a direction parallel to the direction of the tubes so that the ends of the tubes of the first array engage in the holes in the support plate and the ends of the tubes of the second array nest mutually with the curved connectors; and e) applying a relative thrust between the support plate and the tubes of the second array so as to bring about a forced fit of the ends of the tubes of the second array and of the curved connectors.

The support plate is advantageously provided beforehand with a fluid box adapted to communicate subsequently with the tubes of the first array.

In a preferred embodiment of the invention, in operation d), the ends of the tubes of the first array are inserted into seals surrounding the holes in the support plate.

In another preferred embodiment of the invention, in operation a) and in operation d), the ends of the curved connectors project from one face of the support plate facing towards the first and second arrays so that the nested ends resulting from operation d) are spaced from the forced fit openings. The result of this, in operation e), is that the nested ends are a forced fit in the forced fit openings.

The following description is given by way of example only with reference to the accompanying drawings.

DETAILED DESCRIPTION OF THE PREFERRED EMBODIMENT

Figure 1:
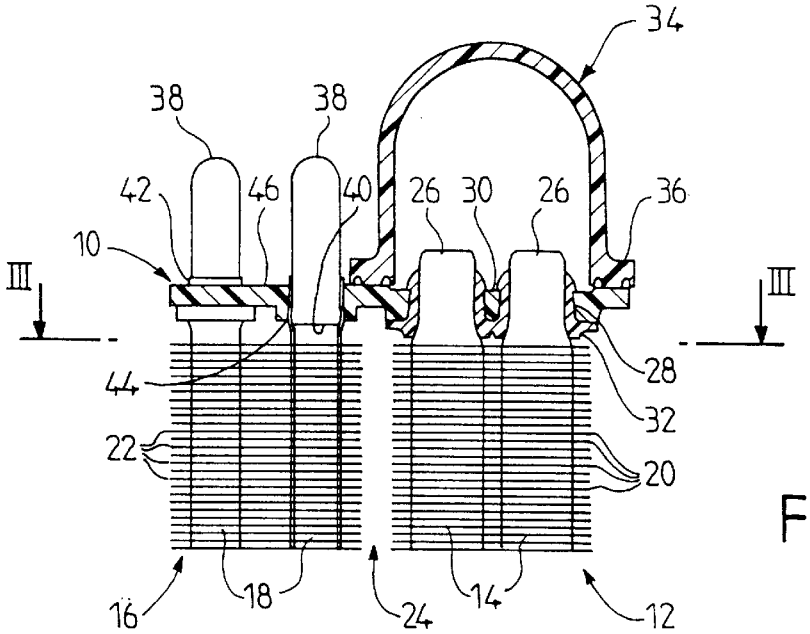
FIG. 1 is a view in cross-section of part of a first embodiment of a heat exchange device in accordance with the invention.
Figure 2:
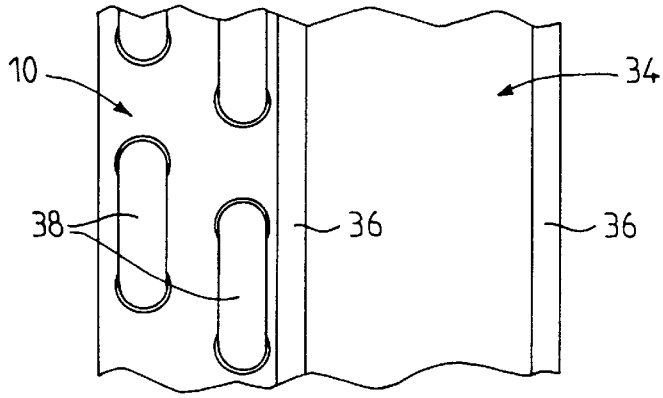
FIG. 2 is a top view of the device in FIG. 1.

The device shown in FIG. 1 comprises a support plate 10 common to a first bundle or array 12 of tubes 14 and a second bundle or array 16 of tubes 18.

Figure 3:
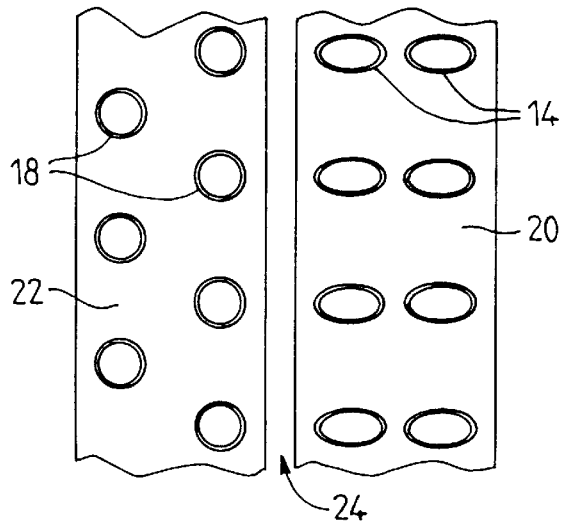
FIG. 3 is a view in section taken along the line III—III in FIG. 1.
Figure 4:
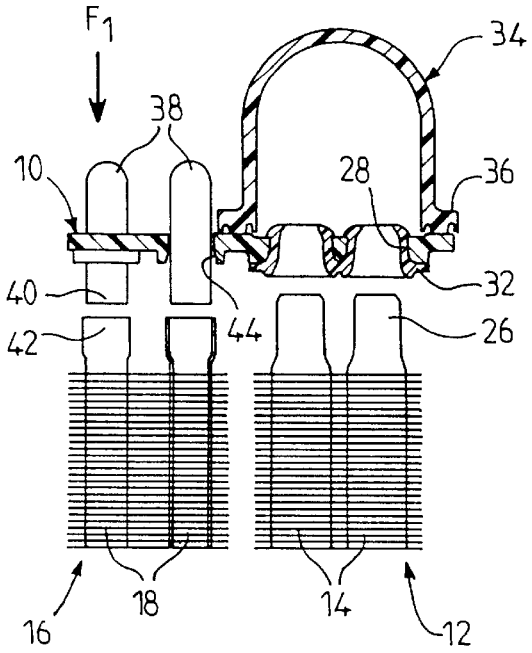
FIGS. 4, 5, 6 and 7 show various steps in the assembly of the device of FIG. 1.
Figure 6:
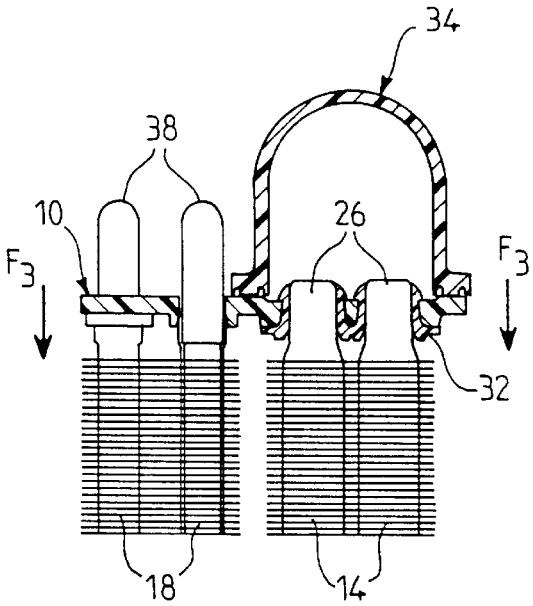

The tubes 14 have an oval section and are disposed in two parallel rows that pass through a set of parallel fins 20 (FIGS. 1 and 3).

The tubes 18 have a circular section and are disposed in two parallel rows that pass through a set of fins 22 (FIGS. 1 and 3).

The tubes 14 and the tubes 18 are parallel to each other and the fins 20 and 22 are separated from each other by a gap 24 (FIGS. 1 and 3) to prevent any transfer of heat between the arrays 12 and 16.

The tubes 14 have circular or oval ends 26 received in two rows of holes 28 through a first part 30 of the support plate 10. This first part 30 serves as a header for the array 12, the ends 26 of the tubes being mechanically assembled to the part 30 by means of compressible seals 32.

The seals 32 are disposed inside the holes and are portions of a common part, made of rubber or a similar material, this technique being well known in the field of heat exchangers.

The tubes 14 of the first array open into a fluid box 34 which has a peripheral edge 36 assembled to the part 30 of the support plate on the opposite side to the array.

In this example the support plate 10 and the fluid box 34 are both made of a plastics material, for example a polypropylene type material, and are friction welded together.

The tubes 18 are connected in pairs by U-shape connectors 38. The connectors 38 have two ends 40 inserted into the ends 42 of the tubes 18. The ends 40 and 42 are a forced fit in two rows of openings 44 through a second part 46 of the support plate 10. In other words this is a purely mechanical assembly entailing radial compression.

The openings 44 have a precise shape, with a conical entry, adapted to assure progressive radial compression of the ends 40 and 42 previously nested one within the other in order to procure a forced fit providing a strong and sealed mechanical assembly without brazing, this technique also being known in itself in the field of heat exchangers.

The manufacture of the device of FIG. 1 will now be described with reference to FIGS. 4 to 7.

The support plate 10 is first friction welded to the fluid box 34. The connectors 38 are then offered up facing the openings 44 in the support plate and inserted in the direction of the arrow F1 (FIG. 4) so that their ends 40 project from the support plate 10.

The arrays 12 and 16 are then disposed facing the support plate 10 so that the ends 26 of the tubes 14 face the holes 28 and the ends 42 of the tubes 18 face the ends 40 of the connectors 38.

Figure 5:
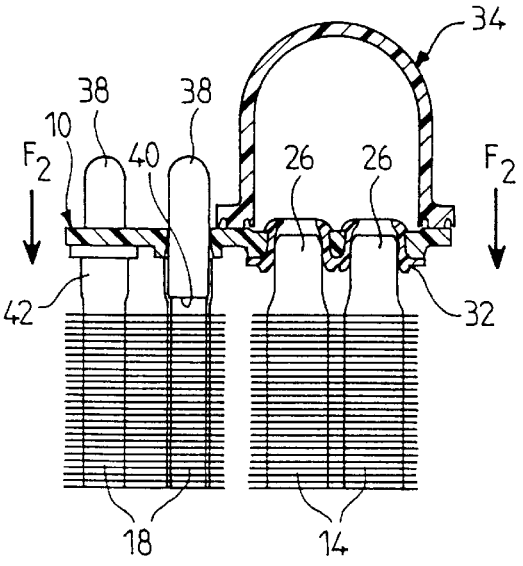
Figure 7:
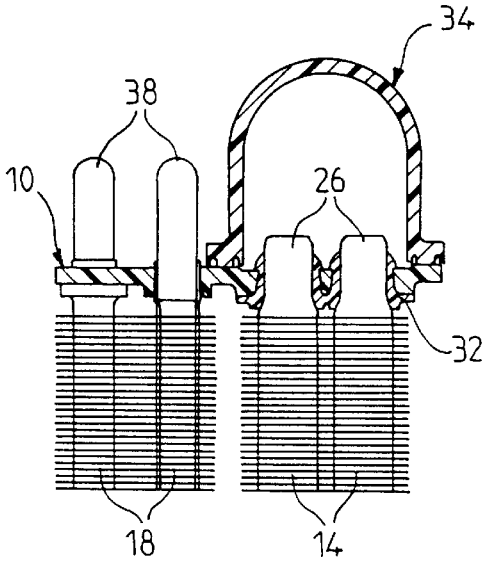

The support plate 10 and the arrays 12 and 16 are then moved towards each other in a direction parallel to the direction of the tubes. In practice it is preferable for the arrays to be fixed and for only the support plate to move in the direction of the arrows F2, as shown in FIG. 5.

In a first phase of this movement, the ends 26 of the tubes 14 engage in the seals 32 and the ends 42 of the tubes 18 nest with the ends 40 of the curved connectors 38. Note that after this operation the ends 40 of the curved connectors still project beyond the support plate because the crimping operation has not yet been carried out.

Then, in a subsequent phase shown in FIG. 6, pressure is again applied in the direction of the arrows F3 which causes complete insertion of the ends 26 of the tubes 14 into the seals 32, which are compressed.

At the same time the support plate 16 moves axially relative to the ends 40 and 42 previously nested in pairs. This procures a forced fit of the nested ends by virtue of the specific shape of the forced fit openings 44.

When the above operation has been completed, a completely assembled device is obtained (FIG. 7) which is similar to that shown in FIG. 1.

Of course, it is possible to carry out a similar operation at the other ends of the tubes using another support plate. The result of this is that the tubes of the array 14 are capped by two fluid boxes and that the tubes of the array 16 are connected by curved connectors at both ends.

Figure 8:
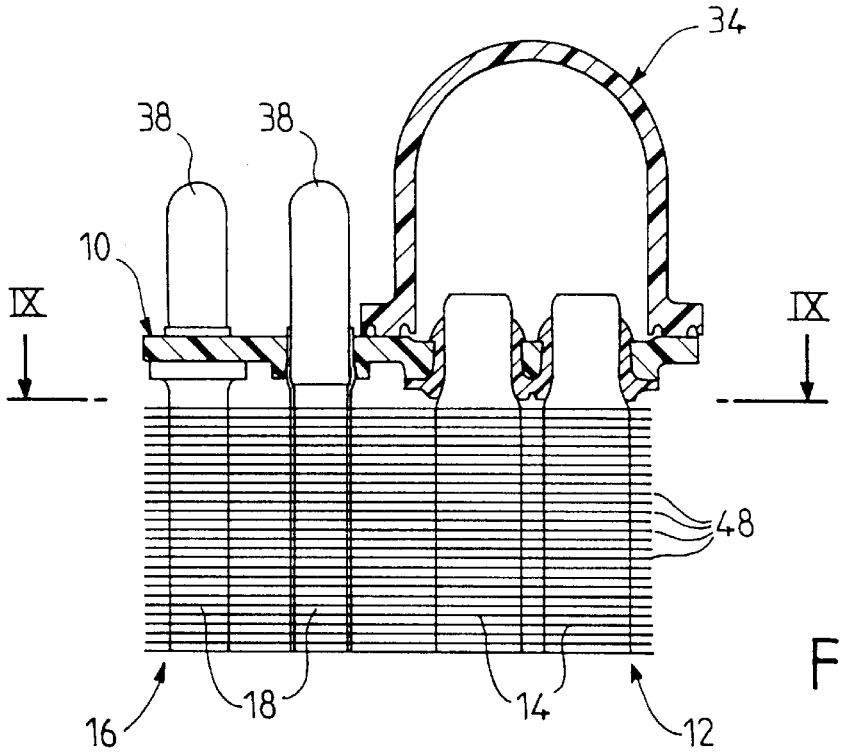
FIG. 8 is a view analogous to that of FIG. 1 showing a second embodiment of a device in accordance with the invention.
Figure 9:
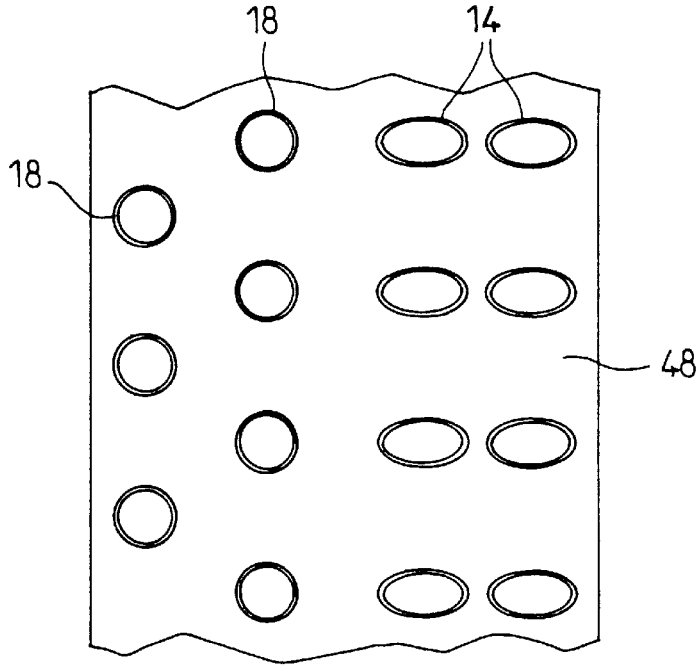
FIG. 9 is a view in section taken along the line IX—IX in FIG. 8.

In the variant shown in FIGS. 8 and 9 a single set of fins 48 is used instead of two separate sets of fins as in the previous embodiment.

To prevent heat transfer between the arrays 12 and 16 it is possible to provide cut-outs in each of the fins 48 in the region corresponding to the gap 24 previously referred to in connection with FIGS. 1 and 3.

In a preferred embodiment of the invention the array 12 is part of an engine cooling radiator, in particular for a motor vehicle. The engine cooling liquid then flows through the tubes 14.

In the above specific application the array 16 is part of an air conditioner, in which case a refrigerant flows through the tubes 18.

It will be understood that the device of the invention can be simply manufactured by mechanical assembly and therefore without brazing. It can be made with various dimensions, in a particularly compact arrangement, with one or more rows of tubes in one or other of the arrays.

Of course, the invention is not limited to the embodiments previously described and encompasses other variants.

In particular, the invention is not limited to the particular cases previously described of cooling an engine and condensing a refrigerant fluid.

What is claimed is:

1. A heat exchange device comprising:

a first array and a second array of heat exchange tubes, each array adapted for the flow of fluids respectively there through, and a support plate having (1) a first portion including a plurality of holes adapted to serve as a header for the first array and (2) a second portion having openings for receiving tubes of the second array with a plurality of curved connectors, the second portion being adapted to receive in a forced fit manner said tubes of a second array with said curved connectors.

2. A heat exchange device as claimed in claim 1, wherein said tubes of said first array and said tubes of said second array are parallel to each other.

3. A heat exchange device as claimed in claim 2, comprising a first set of fins and a second set of fins separated from each other and through which said tubes of said first array and said tubes of said second array pass.

4. A heat exchange device as claimed in claim 2, wherein said tubes of said first array and said tubes of said second array pass through the same set of fins to constitute a one-piece assembly.

5. A heat exchange device as claimed in claim 1, including a fluid box into which said tubes of said first array open and having a peripheral edge assembled to said first portion of said support plate.

6. A heat exchange device as claimed in claim 1, wherein said support plate is made of a plastics material.

7. A heat exchange device as claimed in claim 5, wherein said support plate is made of a plastics material and said fluid box is made of a plastics material and is friction welded to said support plate.

8. A heat exchange device as claimed in claim 1, wherein said curved connectors have ends inserted into ends of said tubes of said first array.

9. A heat exchange device as claimed in claim 1, wherein said first array is part of an engine cooling radiator and said second array is part of an air conditioner condenser.

10. A method of manufacturing a heat exchanger as claimed in claim 1, comprising the following steps:

a) fitting said support plate with curved connectors so that said connectors each have two ends engaged in said openings of said support plate;

b) disposing said tubes of said first array so that their ends face said holes in said support plate;

c) disposing said tubes of said second array so that their ends face the ends of said curved connectors;

d) moving said support plate and said first and second arrays towards each other in a direction parallel to the direction of said tubes so that the ends of said tubes of said first array engage in said holes in said support plate and the ends of said tubes of said second array nest mutually with said curved connectors; and e) applying a relative thrust between said support plate and said tubes of said second array so as to bring about a forced fit of the ends of said tubes of said second array and said curved connectors.

11. A method as claimed in claim 10 further comprising the initial step of fitting said support plate with a fluid box adapted to communicate subsequently with said tubes of said first array.

12. A method as claimed in claim 10 wherein step d) further comprising the step of inserting the ends of said tubes of said first array into compressible seals disposed in said holes of said support plate.

13. A method as claimed in claim 10 wherein in steps a) and d) the ends of said curved connectors project from one face of said support plate facing said first and second arrays so that the nested ends resulting from operation d) are spaced from said forced fit holes and in step e) said nested ends are a forced fit in said forced fit openings.

14. A heat exchange device comprising:

a first array and a second array of heat exchange tubes, each array adapted for the flow of fluids respectively there through; and a support plate having (1) a first portion including a plurality of holes adapted to serve as a header for the first array and (2) a second portion having openings for receiving tubes of the second array with a plurality of curved connectors, the first portion being adapted to receive said tubes of the first array by means of compressible seals, and the second portion being adapted to receive in a forced fit manner said tubes of a second array with said curved connectors.

* * * * *